US006409572B1

(12) United States Patent
Gwon

(10) Patent No.: US 6,409,572 B1
(45) Date of Patent: Jun. 25, 2002

(54) BIG MOUTH DOLL

(76) Inventor: Lay Gwon, 25-19 14th Pl., Astoria, NY (US) 11102

( * ) Notice: Subject to any disclaimer, the term of this patent is extended or adjusted under 35 U.S.C. 154(b) by 0 days.

(21) Appl. No.: 09/983,788

(22) Filed: Oct. 25, 2001

(51) Int. Cl.[7] ..... A63H 3/36
(52) U.S. Cl. ..... 446/339; 446/343; 446/395
(58) Field of Search ..... 446/320, 321, 446/330, 337, 339, 340, 341, 343, 346, 376, 378, 391, 395

(56) References Cited

U.S. PATENT DOCUMENTS

| | | | | | |
|---|---|---|---|---|---|
| 2,519,883 | A | * | 8/1950 | Bustanoby | 446/132 |
| 3,745,696 | A | | 7/1973 | Sapkus et al. | |
| 3,808,735 | A | | 5/1974 | Morrison | |
| 3,841,020 | A | | 10/1974 | Ryan et al. | |
| 4,573,927 | A | | 3/1986 | Newman | |
| 4,761,150 | A | | 8/1988 | Lautenberger et al. | |
| 5,215,493 | A | | 6/1993 | Zgrodek et al. | |
| 5,376,040 | A | * | 12/1994 | Hickman et al. | 446/329 |
| 5,700,178 | A | | 12/1997 | Cimerman et al. | |
| 5,800,242 | A | * | 9/1998 | Clokey | 446/337 |
| 5,862,615 | A | | 1/1999 | O'Rourke | |
| 6,068,536 | A | | 5/2000 | Madland et al. | |
| 6,110,001 | A | | 8/2000 | Chae | |
| D431,058 | S | | 9/2000 | Thomas | |
| 6,123,598 | A | | 9/2000 | Cook | |

* cited by examiner

*Primary Examiner*—Jacob K. Ackun
(74) *Attorney, Agent, or Firm*—Richard C. Litman

(57) ABSTRACT

A stuffed doll which is adapted to simulate human-like facial expressions. The doll is provided with upper and lower movable face members. The upper face member incorporates a simulative human upper lip. The upper member also includes eyes which can be manually adjusted. The lower face member is simulative of a lower lip and jaw of a human. The contours of the upper lip and lower lip are designed such that when the lower lip is moved in a position abutting the upper lip the expression of the doll appears to simulate one of sadness. When the lower lip is spaced from the upper lip, the simulative expression is one of joy. The upper and lower lips may be spaced in extreme open positions such that the doll simulates an exaggerated open or big mouth.

20 Claims, 6 Drawing Sheets

BIG MOUTH DOLL

BACKGROUND OF THE INVENTION

1. Field of the Invention

The present invention generally relates to toys. More specifically, the present invention is drawn to a doll which can be manually manipulated to display simulated human facial expressions.

2. Description of the Related Art

The utilization of toys to assist a child in expressing his/her feelings is a well known and practiced educational and psycho-therapeutic concept. Foremost among the toys utilized for this purpose is the doll. A child is able to make a doll cry, laugh, frown, smile, scowl, etc. in accord with the child's current disposition. Additionally, the doll is fun to play with.

The prior art is rife with dolls for accomplishing the above indicated tasks. For example, U.S. Pat. No. 3,745,696 (Sapkus et al.), U.S. Pat. No. 3,808,735 (Morrison), U.S. Pat. No. 3,841,020 (Ryan et al.), U.S. Pat. No. 5,700,178 (Cimerman et al.), U.S. Pat. No. 6,068,536 (Madland et al.) and U.S. Pat. No. 6,110,001 (Chae) all show dolls having means for changing the doll's facial expression. However, the dolls of the instant patents all employ relatively complicated mechanisms which may easily be broken in the rough and tumble word of child's play.

U.S. Pat. No. 5,215,493 (Zgrodek et al.) discloses a stuffed toy wherein the facial expression may be changed by rotation of the toy's mouth and eyes. The expressions are limited to that of happiness or sadness.

U.S. Pat. No. 6,123,598 (Cook) is drawn to a doll in the form of an animal having a pull mechanism for moving the jaws of the doll to simulate chewing or eating. There is no provision to simulate emotional human expressions.

U.S. Pat. No. 4,573,927 (Newman) shows a doll wherein decal-like facial panels are used to exhibit facial expressions. A child must find and replace a decal on the doll to change the doll's expression. The decals may easily be misplaced and not readily at hand when needed.

U.S. Pat. No. 5,862,615 (O'Rourke) is drawn to a display button using magnets to control the position of rectangular and arcuate members which simulate a human expression. The display button is designed to be worn by adults and manipulation of the rectangular and arcuate members may prove to be to complicated for young children.

U.S. Pat. No. 4,761,150 (Lautenberger et al.) discloses a mechanism utilized to move the eyes of toys, dolls and the like. The patentees do not contemplate changing the facial expression of a doll.

U.S. Pat. No. Des. 431,058 (Thomas) shows the ornamental design of a fabric covered doll. The doll is not designed to change facial expressions.

None of the above inventions and patents, taken either singularly or in combination, is seen to disclose a doll with human-like expressions as will subsequently be described and claimed in the instant invention.

SUMMARY OF THE INVENTION

The instant invention comprises a stuffed doll having a rounded face covered with stretchable fabric. The doll is adapted to simulate human-like facial expressions. To accomplish such simulation, the doll is provided with upper and lower movable face members. The upper face member incorporates a simulative human upper lip. The upper member also includes eyes which can be manually adjusted in downward, upward and side-to-side positions. The lower face member is simulative of a lower lip and jaw of a human.

The contours of the upper lip and lower lip are designed such that when the lower lip is moved in a position abutting the upper lip, the expression of the doll appears to simulate one of gloom or sadness. In contrast, when the lower lip is spaced from the upper lip, the simulative expression is one of joy or happiness. The upper and lower lips may be spaced in extreme open positions such that the doll simulates an exaggerated open or big mouth. A conventional lock/release mechanism allows a user to manipulate the upper and lower members for opening and closing the same.

Accordingly, it is a principal object of the invention to provide a child's toy in the form of a doll, which doll is capable of assuming simulated human facial expressions.

It is another object of the invention to provide a child's toy in the form of a doll, which doll has a minimum number of moving parts.

It is a further object of the invention to provide a child's toy in the form of a doll, which doll is easy to manipulate.

Still another object of the invention is to provide a child's toy in the form of a doll, which doll is safe and aesthetically pleasing.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
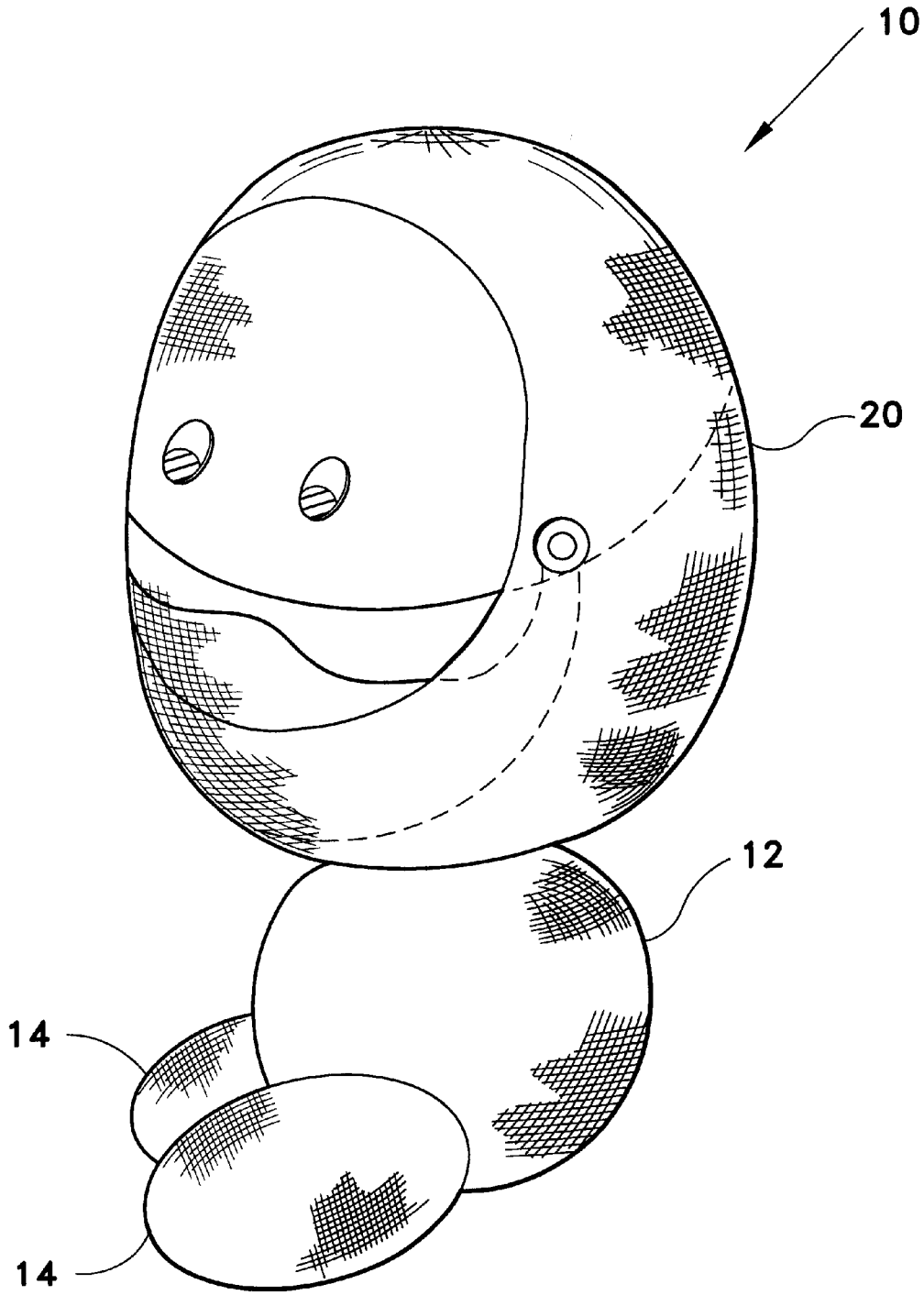
FIG. 1 is a perspective view of a doll with a simulated neutral expression according to the present invention.

Attention is first directed to FIG. 1 wherein the doll of the present invention is generally indicated at 10. Doll 10 comprises a ball-shaped torso 12 having leg-like members 14 attached thereto. Torso 12 and leg members 14 are stuffed in conventional manner, preferably with a non-allergenic material. The outer surfaces of the torso and leg members may be fabricated from any soft, pliable, durable, fire-retardant material.

Figure 5:
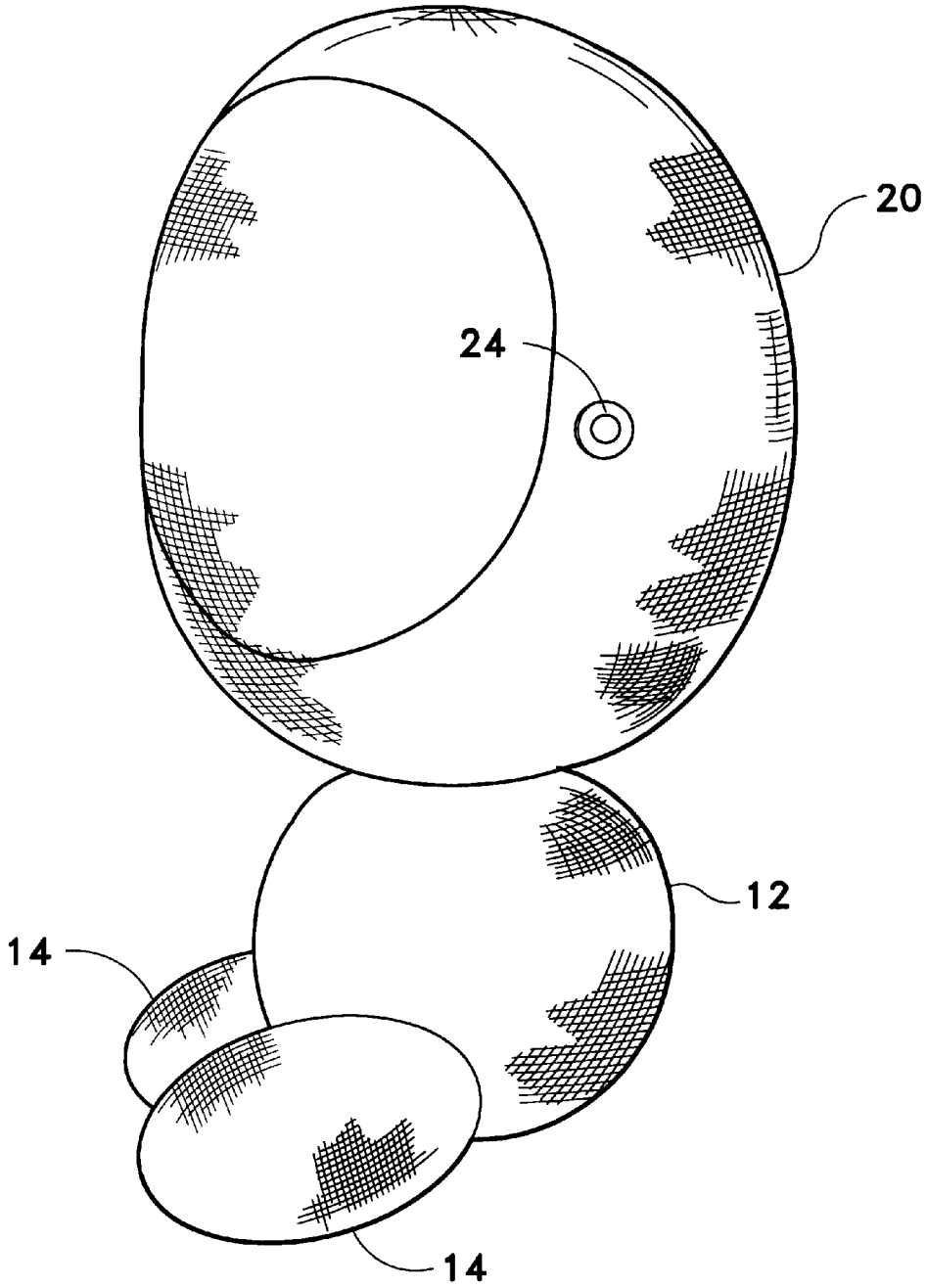
FIG. 5 is a perspective view of a shell of a doll according to the present invention.
Figure 6:
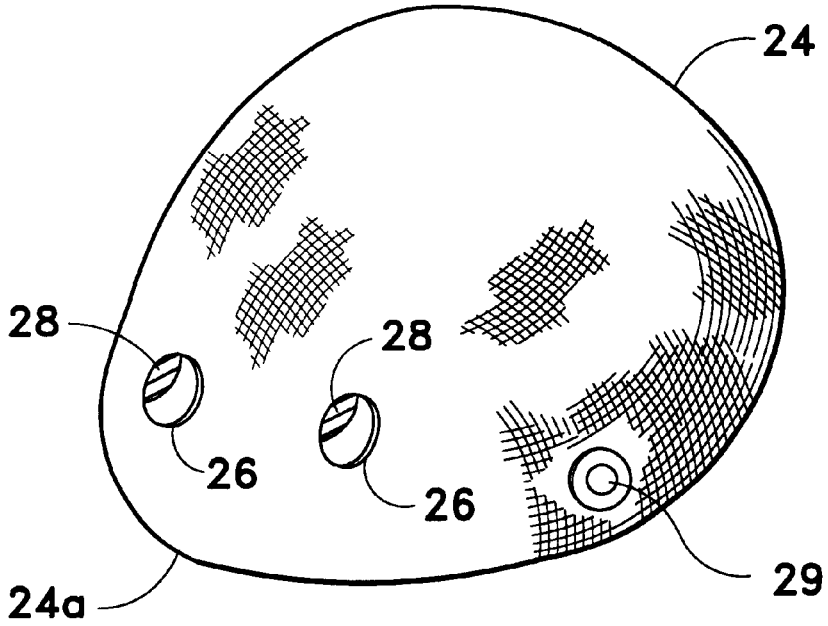
FIG. 6 is a perspective view of an upper face member of a doll according to the present invention.
Figure 7:
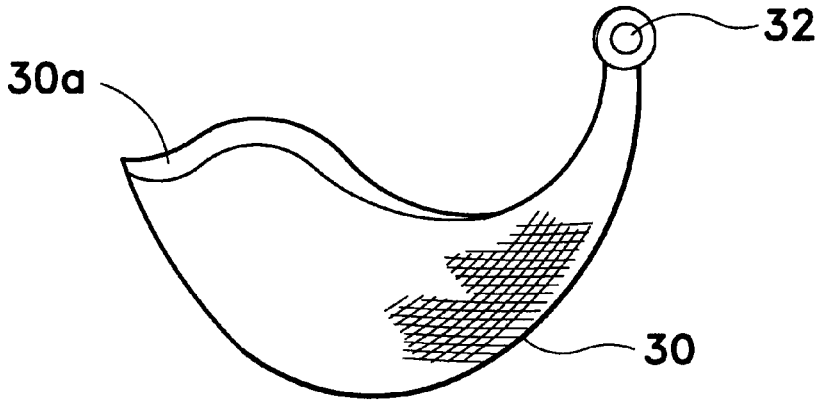
FIG. 7 is a perspective view of a lower face member of a doll according to the present invention.

A head 20 is of an exaggerated size and is attached to the top of the torso 12. As best seen in FIG. 5, head 20 is formed as a globe-shaped hollow shell having an open front. Head

20 is fabricated from a material that will maintain its shape i.e. plastic. A conventional lock/release pivot mechanism 22 is formed on each side (only one is shown) of the head adjacent the open front for reasons as will be later explained. The mechanisms are diametrically opposed.

Figure 3:
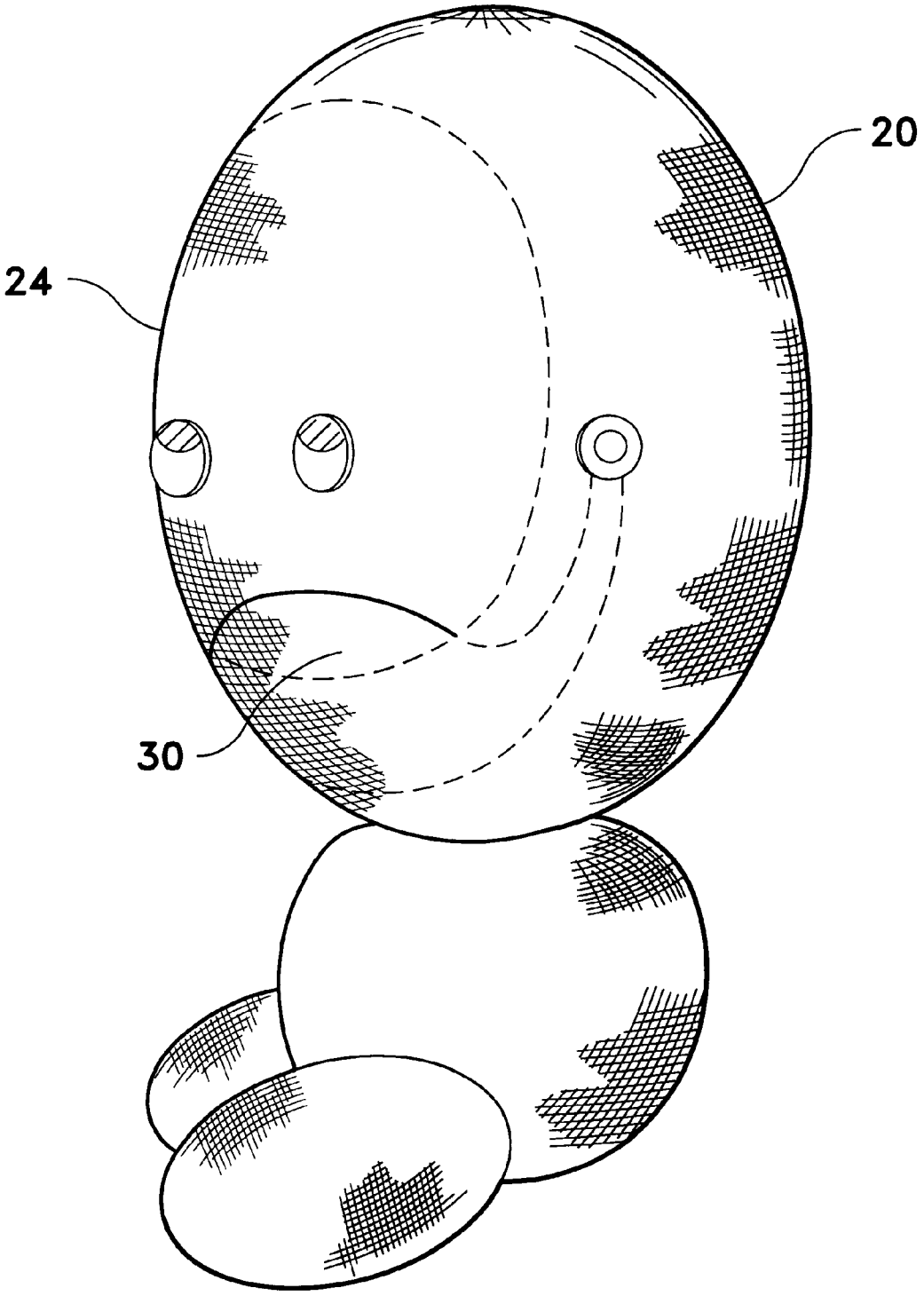
FIG. 3 is a perspective view of a doll with a simulated sad expression according to the present invention.
Figure 4:
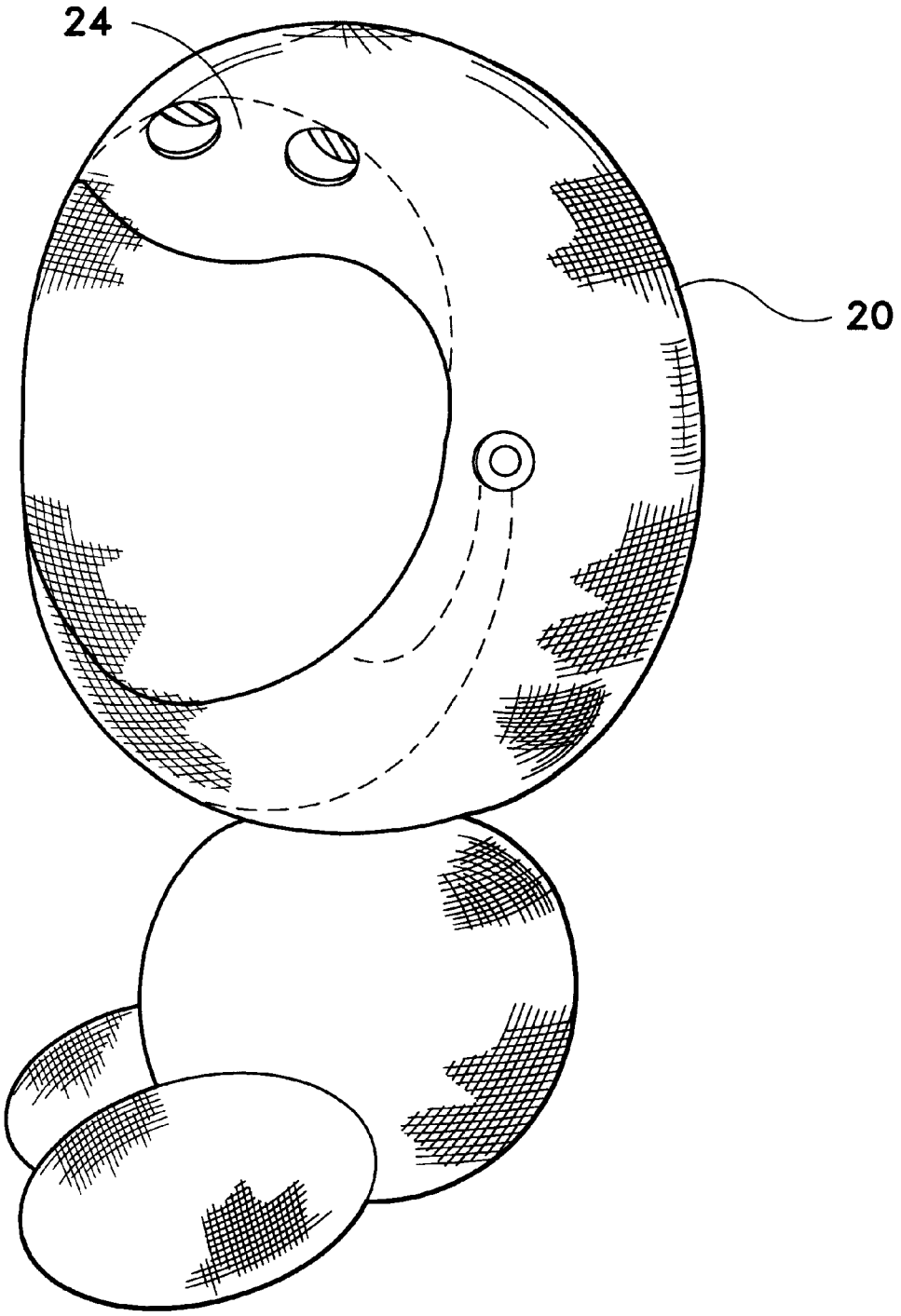
FIG. 4 is a perspective view of a doll with a simulated fully-opened mouth according to the present invention.

Attention is now directed to FIGS. 3 and 4 which illustrate the facial components of the doll. Upper face member 24 is of a hemispheric configuration and is painted in flesh-like tones. A pair of openings 26 is provided to expose simulated eyes 28. Eyes 28 are supported in any convenient manner such that they may be finger-adjusted up, down or side-to-side as desired. Openings 29 (only one is shown) are formed in each side of member 24. Openings 29 are diametrically opposed and are adapted to be positioned on mechanisms 22 for pivotal movement thereon. A lower edge 24*a* of member 24 is simulative of a human upper lip. Lower face member 30 is configured somewhat like the lower jaw of a human. Edge 30*a* is simulative of a human lower lip. Face member 30 is provided with diametrically opposed openings 32 (only one is shown), which openings are also adapted to be positioned on mechanisms 22 for pivotal movement thereon. When assembled, upper face member 24 and lower face member 30 are mounted within head 20 for pivoted movement therein. Merely pushing the mechanisms 29 will allow the user to move the face members to a desired position. The mounted face members are covered with a stretchy fabric to make the members aesthetically pleasing.

Figure 2:
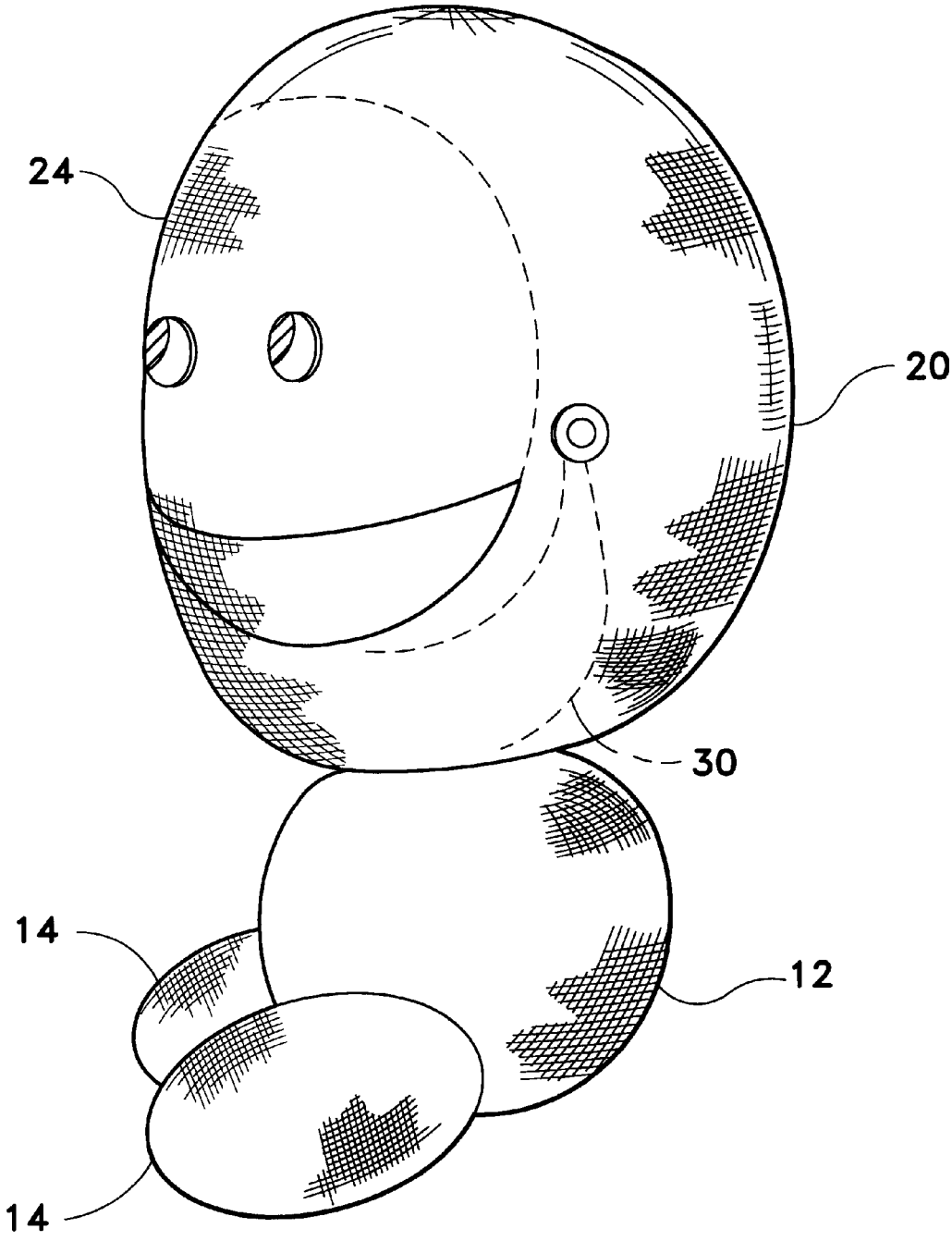
FIG. 2 is a perspective view of doll with a simulated happy expression according to the present invention.

In use, when the upper and lower face members are spaced a slight distance apart, the contours of edges 24*a* and 30*a* will give the doll an appearance of a simulated neutral expression (FIG. 1). When the contoured edges are more widely spaced as in FIG. 2, the appearance is that of a smiling or happy face. When the edges are in abutting relationship (FIG. 3) the doll's appearance is one of sadness. In FIG. 4, the face members are pivoted to a maximum spaced positioned and the doll assumes a "big mouth" appearance.

It is to be understood that the present invention is not limited to the embodiment described above, but encompasses any and all embodiments within the scope of the following claims.

I claim:

1. A doll with human-like expressions comprising:

a torso having an outer surface, a lower end and an upper end;

a globe-shaped hollow head member mounted on the upper end of said torso, said globe-shaped hollow head member having an open front;

a pair of leg-like members mounted on the lower end of said torso;

a pair of lock/release pivot mechanisms mounted on said head adjacent said open front; and means mounted in said globe-shaped hollow head member and on said lock/release pivot mechanisms for allowing said doll to assume simulated human-like expressions.

2. A doll with human-like expressions as recited in claim 1, wherein said means includes an upper face member having an edge which is simulative of a human upper lip.

3. A doll with human-like expressions as recited in claim 2, wherein said means includes a lower face member having an edge which is simulative of a human lower lip.

4. A doll with human-like expressions as recited in claim 3, wherein said upper face member and said lower face member are pivotally mounted on said lock/release pivot mechanisms.

5. A doll with human-like expressions as recited in claim 4, including a pair of openings in said upper face member.

6. A doll with human-like expressions as recited in claim 5, including a pair of members simulative of human eyes respectively positioned in said pair of openings.

7. A doll with human-like expressions as recited in claim 6, wherein said pair of members are adjustable.

8. A doll with human-like expressions as recited in claim 7, wherein said doll assumes a simulative expression of sadness when said edge of said lower face member and said edge of said upper face member are in an abutting relationship.

9. A doll with human-like expressions as recited in claim 7, wherein said doll assumes an expression of happiness when said edge of said lower face member and said edge of said upper face member are in a spaced relationship.

10. A doll with human-like expressions comprising:

a torso having an outer surface, a lower end and an upper end;

a globe-shaped hollow head member mounted on the upper end of said torso, said globe-shaped hollow head member having an open front;

a pair of leg-like members mounted on the lower end of said torso;

said torso and said pair of leg-like members having inner volumes filled with a soft, non-allergenic material;

a pair of lock/release pivot mechanisms mounted on said head adjacent said open front in diametrically opposed positions; and means mounted in said globe-shaped hollow head member and on said lock/release pivot mechanisms for allowing said doll to assume simulated human-like expressions.

11. A doll with human-like expressions as recited in claim 10, wherein said means includes an upper face member having an edge which is simulative of a human upper lip.

12. A doll with human-like expressions as recited in claim 11, wherein said means includes a lower face member having an edge which is simulative of a human lower lip.

13. A doll with human-like expressions as recited in claim 12, wherein said upper face member and said lower face member are pivotally mounted on said lock/release pivot mechanisms.

14. A doll with human-like expressions as recited in claim 13, including a pair of openings in said upper face member.

15. A doll with human-like expressions as recited in claim 14, including a pair of members simulative of human eyes respectively positioned in said pair of openings.

16. A doll with human-like expressions as recited in claim 15, wherein said pair of members are adjustable.

17. A doll with human-like expressions as recited in claim 16, wherein said globe-shaped, hollow head member is fabricated from a plastic material.

18. A doll with human-like expressions as recited in claim 17, wherein said outer surface of said torso is fabricated from a fire retardant material.

19. A doll with human-like expressions as recited in claim 18, wherein said doll assumes a simulative expression of sadness when said edge of said lower face member and said edge of said upper face member are in an abutting relationship.

20. A doll with human-like expressions as recited in claim 18, wherein said doll assumes an expression of happiness when said edge of said lower face member and said edge of said upper face member are in a spaced relationship.

* * * * *